US005509969A

United States Patent [19]

Grawe

[11] Patent Number: 5,509,969

[45] Date of Patent: Apr. 23, 1996

[54] ABATEMENT PROCESS FOR CONTAMINANTS

[76] Inventor: John Grawe, 6726 General Diaz, New Orleans, La. 70002

[21] Appl. No.: 283,176

[22] Filed: Aug. 3, 1994

Related U.S. Application Data

[63] Continuation of Ser. No. 914,386, Jul. 17, 1992, Pat. No. 5,421,897, which is a continuation of Ser. No. 92,427, Jul. 19, 1993, abandoned.

[51] Int. Cl.[6] ..... B08B 7/00

[52] U.S. Cl. ..... 134/2; 134/3; 134/4; 134/6; 134/7; 134/26; 134/27; 134/28; 134/29; 134/38; 134/41

[58] Field of Search ..... 134/4, 6, 26, 27, 134/28, 29, 38, 2, 3, 7, 41

[56] References Cited

U.S. PATENT DOCUMENTS

| | | | |
|---|---|---|---|
| 4,476,177 | 10/1984 | Mizuno et al. | 428/206 |

FOREIGN PATENT DOCUMENTS

| | | | |
|---|---|---|---|
| 1204647 | 5/1986 | Canada | 134/4 |
| 2634774 | 2/1990 | France . | |
| 57-212267 | 12/1982 | Japan . | |
| 58-000799 | 1/1983 | Japan . | |
| 59-189200 | 10/1984 | Japan . | |
| 9189200 | 10/1984 | Japan | 134/4 |
| 60-100098 | 6/1985 | Japan . | |
| 60-170674 | 9/1985 | Japan . | |
| 0170674 | 9/1985 | Japan . | |
| 7414461 | 5/1976 | Netherlands . | |
| 969556 | 10/1982 | U.S.S.R. . | |

OTHER PUBLICATIONS

Laurie, "Tetrathiomolybdate (VI) as an Antidote in Acute Intoxication by Copper (II) and Other Toxic Metal Ions," *Inorg. Chem. Acta,* 91:121–123 (1984) no month.

Stine et al., "N–(2,3–Dimercaptopropyl)phthalamidic Acid: Protection, *in Vivo and in Vitro,* against Arsenic Intoxication," *Toxicology and Applied Pharmacology,* 75:329–336 (1984). no month.

Fine et al., "Use of Strippable Coatings To Protect and Clean Optical Surfaces," *Applied Optics,* 26(16):3172–3173 (1987) Aug. 1987.

Jones, "Ethylenediaminetetra(methylenephosphonic) Acid (EDTPO) As A Therapeutic Chelating Agent," *Toxicol. Lett.,* 16(I–2): 117–121 (1983).

"BIX®Spray–On Stripper" product brochure no date.

*Primary Examiner*—Zeinab El-Arini
*Attorney, Agent, or Firm*—Foley & Lardner

[57] ABSTRACT

A process for cleaning a surface contaminated with an organic, acidic or basic contaminant. In the process, a liquid-state composition including an agent selected form the group consisting of an absorbant, an acid-neutralizing agent and a base-neutralizing agent is applied to the surface, and allowed to interact with the contaminant to form a product and to solidify into a solid-state matrix which sequesters the product. The solid-state matrix is then removed from the surface, thereby substantially cleaning the surface of the contaminant. There is also a process wherein a second liquid-state composition including a functionally different composition is applied to the surface. The second liquid-state composition may enhance the removability of the solid-state matrix from the surface.

28 Claims, No Drawings

ABATEMENT PROCESS FOR CONTAMINANTS

CROSS-REFERENCE TO RELATED APPLICATION

This application claims benefit under 35 U.S.C. § 120 and application is a continuation of Ser. No. 07/914,386, filed Jul. 17, 1992, now U.S. Pat. No. 5,421,897, which is a continuation of application Ser. No. 08/092,427, filed Jul. 19, 1993, now abandoned, the disclosures of which are expressly incorporated herein by reference.

FIELD OF THE INVENTION

This invention relates to processes for the abatement of contaminants. More particularly, this invention relates to non-rinsing cleanup processes for neutralizing acidic or basic residue remaining after paint stripping and for absorbing organic substances remaining after paint stripping.

BACKGROUND OF THE INVENTION

Chemical paint removal processes commonly involve the application of organic, acid or basic formulations to the painted surface. In many cases, these formulations remain in contact with the painted surface for 48 hours or longer, providing sufficient time for porous surfaces such as wood, cement, brick, plaster, and the like to absorb the organic, acid or basic compounds present in the formulations, and thus to become contaminated with these compounds. This contamination may pose a health threat to those in the proximate surroundings of the treated surfaces, and often causes premature failure of coatings applied over the treated surfaces.

In order to reduce the future release of the organic, acid or basic compounds from contaminated surfaces, it is common practice to treat the surfaces with a post-paint removal wash designed to extract or neutralize the contaminant. For example, surfaces that were stripped with organic-based paint removers and that are thus contaminated with organic compounds are rinsed with an organic solvent; surfaces that were stripped with acidic paint removers and that are thus contaminated with acidic compounds are rinsed with a basic or caustic solution, and surfaces that were stripped with basic or caustic paint removers and that are thus contaminated with basic compounds are rinsed with an acidic solution.

There are several problems associated with this type of after-treatment, however. First, these treatments must be performed with careful understanding and monitoring of neutralization stoichiometry because over-treatment can result in the creation of a new hazard. For example, if a surface contaminated with a basic compound is after-treated with an excess of an acidic solvent, the resulting surface will be contaminated with an acidic compound. Additionally, washing the surfaces with these after-treatment solutions generates liquid hazardous waste that is difficult to collect and expensive to dispose of. For example, when washing a wall with an after-treatment solution, the solution will run onto the floors and may be absorbed into them, creating yet another contaminated surface. Thus, there is a need for a post-paint removal treatment process that can clean the surface, such as by neutralizing and/or removing the surface contaminant, without creating a new source of contaminant, and without creating liquid waste.

Summary of the Invention

Accordingly, it is an object of this invention to provide a process for cleaning a surface contaminated with an organic, acidic or basic contaminant.

It is another object of the present invention to provide a composition for cleaning a surface contaminated with an organic, acidic or basic contaminant.

Thus, one aspect of the present invention provides a process for substantially cleaning a surface contaminated with an organic, acidic or basic contaminant. In the first step of this process, a liquid-state composition comprising an agent selected from the group consisting of an absorbant, an acid-neutralizing agent and a base-neutralizing agent is applied to a surface comprising the contaminant. In the second step, the liquid-state composition is allowed to interact with the contaminant to form a product and to solidify into a solid-state matrix which sequesters the product. Finally, the solid-state matrix is removed from the surface, thereby substantially cleaning the surface.

The present invention also provides a two-coating process for substantially cleaning a contaminated surface. In this process, two functionally different compositions are applied to the surface. The first composition, the surface contact composition, comprises an agent selected from the group consisting of an absorbant, an acid-neutralizing agent and a base-neutralizing agent. This composition is applied to the surface, and allowed to interact with the contaminant to form a product. The second composition, the overcoat composition, may provide other characteristics such as increased removability, tear resistance, additional neutralization, and flame retardancy. This overcoat composition is applied over the surface contact composition, and the compositions are allowed to solidify into a solid-state matrix which sequesters the product. Finally, the solid-state matrix is removed from the surface, thereby substantially cleaning the surface. The two-coating process may be less expensive to carry out than the single-coating process.

Another aspect of the present invention provides a liquid-state composition useful for substantially cleaning a surface contaminated with an organic, acidic or basic contaminant.

Additional objects and advantages of the invention will be set forth in part in the description that follows, and in part will be obvious from the description, or may be learned by practice of the invention. The objects and advantages may be realized and obtained by means of the processes and compositions particularly pointed out in the appended claims.

DETAILED DESCRIPTION OF THE PREFERRED EMBODIMENTS

This invention provides processes for cleaning a surface contaminated with an organic, acidic or basic contaminant, in particular, for cleaning a surface that has been treated with a chemical paint remover.

In accordance with one aspect of this invention, a surface contaminated with organic, acidic or basic contaminants, such as those present on a surface after it has been treated with a chemical paint remover, can be cleaned by (a) applying a liquid-state composition to the surface, wherein the liquid-state composition comprises an agent selected from the group consisting of an absorbant, an acid-neutralizing agent, and a base-neutralizing agent, (b) allowing the liquid-state composition to interact with the contaminant to form a product and to solidify into a solid-state matrix which sequesters the product, and (c) removing the solid-state matrix from the surface. The solid-state matrix may also sequester unreacted contaminant and unreacted agent.

Typical surfaces to be cleaned include wood, cement, brick, cinder block, plasterboard, and wallboard.

Example of contaminants which may result from organic strippers include dichloromethane, chloroform, 1,1,2-trichloroethane, 1,2,3-trichloropropane, dichlorobenzenes, dimethylsulfoxide, dimethyl formamide, furfural, methanol, propanol, tetrahydrofuran, methyl ethyl ketone, acetone, anisole, butyl acetate, cyclohexanone, limonene, propylene glycol, butyl cellosolve, ethoxyethanol, ethyl acetate, ethylene glycol monomethyl ether, methypyrrolidone, benzyl alcohol, diacetone alcohol, dioxane, toluene, dimethyl phthalate, dimethyl acetamide, xylene, hydrocarbons, petroleum distillates, naphtha, naval stores, and dialkyl maleates.

Example of contaminants which may result from acid-containing strippers include acetic acid, chloroacetic acid, aromatic thiols, phenol, cresol, formic acid, oxalic acid, glycolic acid, phosphoric acid, toluenesulfonic acid, fluorosulfuric acid, hydrofluoric acid, hydrochloric acid, sulfuric acid and nitric acid.

Examples of contaminants which may result from alkaline-containing strippers include sodium hydroxide, sodium metasilicate, potassium hydroxide, lithium hydroxide, calcium hydroxide, calcium oxide, trisodium phosphate, ammonium hydroxide, ethylenediamine, polyethylenepolyamines, triethanolamine, hydrazine, morpholine, pyridine, and quaternary ammonium compounds.

The liquid-state composition is preferably a polymer composition comprising an absorbant or neutralizing agent. The liquid-state composition may also contain one or more optional additives which enhance the abatement processes described herein. Representative suitable polymer components and optional additives are discussed in detail below.

Any conventional method of application such as pouring, rolling, manual or assisted spreading, brushing, aerosol spraying, air or airless spraying is suitable. Generally, the liquid-state composition is applied at between 10 to 60 mils wet film thickness. As contact takes place, the liquid-state composition begins to remove the contaminant from the surface through wetting, molecular aggregations, micellular inclusion, dispersion, suspension, solubilization, and adsorption into the liquid-state composition. On nonporous surfaces like painted plasterboard and painted wood the action of the liquid-state composition and the force of spray impact may be sufficient to achieve commingling of the contaminant and the liquid-state composition. On highly porous surfaces, such as cinder block and cement, the liquid-state composition may be manually or power brushed, scrubbed or scoured to assist in dislodging and sequestering the contaminant in the liquid-state composition. Alternatively, packaging the liquid-state composition in aerosol spray-can form allows the use of foaming, effervescent and blowing agents that provide lifting and suspending action.

After the liquid-state composition has been applied, it is allowed to interact with the contaminant to form a product. By "interact" is meant all chemical and physical reactions and interactions that occur between the liquid-state composition and the contaminant. By "product" is meant the substance that results from the reactions and interactions. This product does not have to be a different chemical product, per se, but may also be a physical product, such as results when contaminant is adsorbed to a species of the liquid-state composition.

For example, when the contaminant is acidic or basic and the liquid-state composition comprises a neutralizing agent, the interaction may comprise a neutralization reaction, and the product may comprise a salt. When the contaminant is organic and the liquid-state composition comprises an absorbing agent, the interaction may comprise absorption, adsorption, and other interactions, such as van der Waals forces, physical inclusion and entrapment, that occur between the contaminant and the liquid-state composition. The product in this case would be the absorbed, adsorbed, included or entrapped contaminant.

As this interaction occurs, the liquid-state composition also forms a solid-state matrix. The solidification process may occur by the evaporation of the carrier solvents, or it may be hastened by the use of a drying agent. As the liquid-state composition loses its carrier/solvent component, a transformation occurs and the soluble or dispersed polymeric material forms a solid-state matrix that sequesters the product, as well as unreacted contaminant, and unreacted agent. As the solid-state matrix forms, interactions occur between the composition and the product, and unreacted contaminant and agent so that compounds located at the interfacial surface become bonded to the composition, and compounds present in the internal regions become locked in. This provides an element of safety by absorbing and entraining the contaminants, including the product, and unreacted contaminant and agent in the solid-state matrix. As used herein, the term "sequester" includes all physical and chemical means by which a compound becomes associated with a solid-state matrix, including absorption, adsorption, physical entrapment, chemical reactions, etc.

Upon complete evaporation of the carrier/solvent component, the solid-state matrix preferably develops a high degree of tear, tensile and cohesive strengths. The preferred solid-state matrix displays a cohesive-to-adhesive strength ratio that has a value of at least about one and is capable of being removed from the applied surface by simple physical peeling. Release aids may be included in the liquid-state composition to achieve the proper ratio of cohesive-to-adhesive strengths and facilitate removal.

While the solid-state matrix may display a high degree of elongation (200 to 1000%), the physical and chemical interactions with the contaminant are sufficient to prevent loss of the contaminant upon peeling. The solid-state matrix located in pores, cracks, crevices and the like is pulled from these regions upon removal of the overall solid-state matrix and remains appendaged to the bulk of the solid-state matrix upon peeling. Once removed, the solid-state matrix may be rolled, folded or compacted in convenient sizes and shapes, and bagged for subsequent treatments or processed as is for disposal.

In addition to sequestering the organic, acidic or basic contaminants of the surface to be cleaned, the matrix will also sequester the bulk of the paint/stripper residue, so that when the solid-state matrix is removed a surface substantially free of residue and contaminants is achieved.

The present invention also provides a two-coating process for cleaning a contaminated surface. This process is much like the process described above, except that two compositions are applied to the surface in two separate coatings. The first composition, the surface contact composition, comprises an agent selected from the group consisting of an absorbant, an acid-neutralizing agent and a base-neutralizing agent, and provides neutralization and/or cleaning of the surface. This composition is applied to the surface and allowed to interact with the contaminant.

The second composition, the overcoat composition, may provide other characteristics to the cleaning process, such as increased removability, tear resistance, additional neutralization, and flame retardancy. This overcoat composition is applied over the surface contact composition, and the compositions are allowed to solidify into a single solid-state matrix which, like the solid-state matrix resulting from the single-coating process described above, sequesters the product, and unreacted contaminant and agent. Finally, the solid-state matrix is removed from the surface, thereby substantially cleaning the surface.

While both the surface contact liquid-state composition and the overcoat liquid-state composition may contain any of the polymeric components and/or optional additives set forth below, proper selection of the components of the two compositions may afford cost savings. When the single-coating process is used, enough composition must be applied to both clean the surface and provide a layer that is thick enough to form a strippable solid-state matrix. In contrast, when the two-coating process is used, the amount of surface contact composition needed must only be sufficient to neutralize and clean the surface. The removability is provided by the overcoat composition, which is applied over the surface contact composition at a greater thickness. If only the surface contact composition comprises the more expensive cleaning and neutralizing components, and the overcoat composition comprises only the less expensive matrix-forming components, cost savings is achieved.

For example, instead of applying a cleaning composition at a thickness of from 10 to 60 mils, the surface contact composition can be applied at a thickness of only a few mils, with the bulk of the matrix-forming composition coming from the less expensive overcoat composition. This two-coating process achieves cost savings without sacrificing surface cleaning or removability of the composition.

While one course of either the single-coating or two-coating processes described above is usually adequate to reduce contaminant levels to desired ranges, unusually difficult situations may require multiple courses of treatment. In these cases, reapplication of the compositions would continue until acceptable limits had been achieved. Preferably, one application of the liquid-state composition would effect removal of from at least about 25% to about 95% of contaminant on the surface, thereby providing effective cleaning of the surface.

The compositions and processes of the instant invention are also useful for removing lead (such as lead from lead-based paint) and other contaminants from surfaces, and for detecting and mitigating the toxicity of contaminants in and on surfaces, as described in related application Ser. No. 07/914,386, filed Jul. 17, 1992, and 08/092,427, filed Jul. 19, 1993. The entire disclosures of these applications are expressly incorporated herein by reference.

Lead in paint may arise from lead-based paint, which typically comprises at least about 0.5% lead, or from paint with a lower lead content, for example, a paint comprising at least about 0.05% lead. Paints that may comprise lead include paints that comprise lead driers, basic carbonate white lead, basic sulphate white lead, basic silicate white lead, leaded zinc oxide, red lead, lead chromate, lead oxide chromate, and lead molybdate. The rinseless processes of the present invention may be used to effect the cleaning of a surface comprising lead from paint, wherein the paint/stripper residue is neutralized and/or absorbed, and the residue, including the lead, is removed from the surface.

Useful Liquid-State Compositions

The liquid-state compositions used in the processes of this invention can be a polymer composition which may contain one or more optional additives. The polymers and additives are useful in such compositions as described below.

A. Polymeric Components

The polymeric component of the composition plays an important role in both the liquid and the solid states. In the liquid state, the polymeric component affects the rheological properties of the liquid-state composition, and thus its ability to penetrate inaccessible surface areas where contaminant may be hidden, by altering internal surface area, interfacial free energy, interfacial friction and medium viscosity. Furthermore, the polymeric component's surface active properties, interaction abilities, associative forces and sorption propensities help break surface/contaminant bonds and lift the contaminant from the surface and carry it into the liquid-state composition. The organic phase of the liquid-state composition also acts as an absorbant for organic contaminants, and the polymeric components of the liquid-state composition contribute to the removal of organic contaminants from the treated surface.

Upon evaporation of the volatile components and the formation of a continuous solid-state matrix, additional physical and chemical interactions occur which sequester and bind the contaminant in the solid-state matrix.

Removing the solid-state matrix with the sequestered contaminant from the contact surface requires the proper balance of cohesive and adhesive energy densities so that ease of removal is obtained. The preferred solid-state matrix possesses a structure- property relationship such that the ratio of cohesive force to adhesive force equals or is greater than a value of 1.

Useful polymeric components for this invention, which can be in solution or dispersion form, include: acrylonitrile-containing copolymers; acrylonitrile/butadiene/styrene copolymers, such as Goodrich Hycar 1570×19 and Hycar 1572×64, Goodyear Chemigum LCG-61c, Chemigum Latex 260, and Reichold Tylac 68-074; butadiene copolymer rubbers; butadiene-styrene copolymers, such as Kryton 0076 latex, BASF Butofan NS 248 and Butonal NS 104; Polysar carboxylated SBR D9-3266, 1130 and 3444; Good-rite 1800-73; Dow latex DL 233NA; Reichhold Tylac 68309 and Tylac 97882; chlorinated butadiene-styrene rubber; chlorinated butyl rubber; chlorinated isoprene rubber; chlorinated polyethylene; chlorosulfonated polyethylene; chlorinated rubber, such as Hercules Parlon S-20, ICI Alloprene 20, and Dupont Hypalon CP; chlorinated Neoprene rubbers; chloroprene rubber, such as Dupont Neoprene 622; chloroprene copolymers with methacrylic acid, such as Dupont Neoprene 115; chloroprene copolymers with 2,3-dichloro-1,3-butadiene, such as Dupont Neoprene 400; EPDM rubbers, such as Burke-Palmason EPDM latex EP-603A; cellulosics; cellulose ethers; natural rubber, such as Goodyear GNL 150 and GNL 200, cis-1,4-polyisoprene, trans-1,4-polyisoprene, cyclized polyisoprene, Hevea rubber, Gutta Percha rubber, and epoxidized natural rubber; phosphazene rubber; polyacrylate homopolymers, copolymers and vehicles, like Ucar vehicle 441, Rohm and Haas Emulsion E 1791 and Unocal RES 1019; polyacrylate copolymers containing acrylic or methacrylic acids; polydimethylsiloxane; polysulfide rubber, such as Thiokol LP water dispersion; poly(vinyl acetate) homopolymer and copolymers such as Air Products Flexbond 325 and Airflex 400; poly(vinyl alcohol), such as Air Products Vinol 205 and Vinol 325; poly(vinyl butyral) or (vinyl formal), such as Monsanto Butvar dispersion BR resin; poly(vinyl chloride) homopolymer and copolymers;

chlorinated poly(vinyl chlorides); poly(vinyl chloride-vinyl acetate) copolymers, such as Geon 460×55, Ucar VAGH vinyl resin and Ucar VYNS-3 vinyl resin; urethane rubbers; polyether urethanes; polyester urethanes; polyurethane dispersions, like Bayhydrol 123; epichlorohydrin rubbers; ethylene oxide/propylene oxide rubbers; isobutylene rubbers, and poly(perchloroethylene). Those skilled in the art will appreciate that this list is only exemplary and that other polymeric components can be used. The polymeric component may comprise, for example, from about 10% to about 70%, preferably from about 40% to about 60%, of the liquid-state composition, based on the total weight of the liquid-state composition.

B. Absorbants

When cleaning surfaces contaminated with organic materials, absorbants such as gypsum, calcium carbonate with oil absorption above 20 g/100 g pigment, silica, china clay, talc, asbestine, mica, bentonite, carbon black, activated carbon, vermiculite and perlite may be used as components of the liquid-state composition. The absorbants may comprise, for example, from about 1% to about 40% of the liquid-state composition, based on the total weight of the liquid-state composition.

C. Acid-neutralizing Agents

When cleaning surfaces contaminated with acidic contaminants, acid-neutralizing agents may be used as components of the liquid-state composition. Such agents include alkali metal bicarbonates, such as sodium bicarbonate; alkali metal hydroxides, such as cesium hydroxide, potassium hydroxide, and sodium hydroxide; alkali metal phosphates, such as tetrapotassium pyrophosphate, and trisodium phosphate; alkali metal silicates, such as potassium metasilicate and sodium metasilicate; ammonium hydroxide; dialkyl substituted ammonia derivatives, such as dimethylamine, diethylamine, diisopropylamine, diethanolamine, morpholine, piperazine and piperidine; monoalkyl substituted ammonia derivatives, such as methylamine, ethylamine, and ethanolamine, and trialkyl substituted amines, such as trimethylamine, triethylamine and triethanolamine. Agents such as tetrapotassium pyrophosphate and trisodium phosphate can also serve as dispersants for the contaminant by providing suspending action. These agents may comprise, for example, from about 0.1% to about 20% of the liquid-state composition, based on the total weight of the liquid-state composition.

D. Base-neutralizing Agents

When cleaning surfaces contaminated with basic or caustic contaminants, base-neutralizing agents may be used as components of the liquid-state composition. These agents are compounds that are capable of lowering the pH of water below 7. Typical base-neutralizing agents include, but are not limited to mineral acids, such as hydrochloric acid, phosphoric acid, nitric acid, sulfuric acid, boric acid, carbonic acid, and chromic acid, and organic acids such as acetic acid, adipic acid, benzoic acid, butyric acid, chloroacetic acid, citric acid, cresol, dichloroacetic acid, formic acid, fumaric acid, lactic acid, malonic acid, napthalenesulfonic acid, oleic acid, oxalic acid, phenolic acid, phthalic acid, quinolinic acid, and uric acid. These agents may comprise, for example, from about 0.5% to about 25% of the liquid-state composition, based on the total weight of the liquid-state composition.

E. Optional Additives

The addition of one or more agents, aids, modifiers, functional additives, dispersants, complexing molecules, antidotal compounds and macromolecules to the liquid-state composition can contribute to the efficient accomplishment of the processes described herein. Examples of these optional additives include dispersants, wetting agents, degreasing agents, foaming enhancing agents, rheology control agents, release aids, agents which lower the glass transition temperature ($T_g$), fire retardant agents, as well as other additives and pigments.

1. Dispersants

Dispersants afford a primary cleaning function by lowering the internal energy and surface tension to provide better integration between the liquid-state composition and the contaminant. Dispersants associate with the surface of the contaminant and, by means of molecular aggregation and micelle formation, remove the contaminant from its resting position on the surface and lift it into the bulk of the liquid-state composition.

Preferred amounts of dispersant range from about 0.01 to about 5%, based on the total weight of the liquid-state composition. Examples of dispersants include: Alkasperse DM-5 and Alkasperse M-5, anionic copolymer sodium salts; AMP-95, a 2-amino-2-methyl-1-propanol; Byk 156, an ammonium salt of an acrylic acid copolymer; Emcol K-8300, a half ester disodium sulfosuccinate derived from an alkanolamide; Surfynol 61, a 3,5-dimethyl-1-hexyn-3-ol; Surfynol GA, a blend of non-ionic surfactants; Witcamide 5130, a modified alkanolamide; Witcolate D-510, a sodium 2-ethylhexyl sulfate; Witconate 79S, an amine alkylaryl sulfonate; Witconol NP-100, an alkylaryl polyether alcohol; Witconol RDC-D, a di-glycol coconate.

2. Wetting Agents

Wetting agents perform several important functions, such as stabilizing the liquid-state composition from phase separations, lowering the internal energy of the liquid-state composition so that components with widely different energies are homogenized, and lowering the surface tension so that spreading and penetration occurs on all types of surfaces. These agents aid the cleaning process by providing detergency, emulsification, foaming, solubilization and wetting. The preferred level of use provides a liquid-state composition surface tension below about 40 dynes/cm$^2$. Preferred amounts of wetting agents thus generally range from about 0.05 to about 6%, based on the total weight of the liquid-state composition.

Examples of useful wetting agents include: Alkamide 2104, a cocamide DEA; Alkamuls PSML-20, a sorbitan ester ethoxylate; Alkasurf IPAM, an alkylbenzene sulfonate of isopropylamine; Antarox LF-330, a modified alkyl ethoxylate; Emcol 4500, a sodium diester sulfosuccinate; Emphos CS-1361, a phosphate ester of alkylaryl ethoxylate; Emulphogene BC-840, a polyoxyethylated tridecyl alcohol; Igepal CO-630, a nonylphenol ethyleneoxide condensate; Pegol P-75, a block copolymer of ethylene oxide and propylene oxide; Silwet L-77, a polyalkylene oxide-modified polymethylsiloxane; Steol CS-460, a sodium lauryl ethoxysulfate; Stepanol WA-extra, a sodium lauryl sulfate; Triton X-100, an octylphenol polyether alcohol; Triton X-301, a sodium alkylaryl polyether sulfate; Troysol S366, a nonionic surface active agent; Tween 20, a polyoxyethylene (20) sorbitan monolaurate; Witconate 45, a sodium alkylarylsulfonate; Witcolate 1276, an alcohol ether sulfate; Witconol 171, a polyalkylene glycol ether; and Zonyl FSK, a fluorosurfactant.

3. Degreasing Agents

Cleaning efficiency is further enhanced by the use of degreasing agents. Preferred amounts of degreasing agents range from about 0.5 to about 10%, based upon the total weight of the liquid-state composition. Examples of degreasing agents include: acetone, 1,4-butanediol, cellosolve acetate, cyclohexanol, cyclohexanone, diacetone alcohol, diethylene glycol, dimethylformamide, dimethylsulfoxide, dipropylene glycol, Ektasolve EB-ethylene glycol monobutyl ether, ethyl acetate, ethyl alcohol, ethylene glycol, furfuryl alcohol, glycerine, isophorone, isopropyl alcohol, isobutyl carbinol, methyl ethyl ketone, methyl carbinol, n-propyl acetate, n-propyl alcohol, propylene glycol, M-Pyrol, tetrahydrofuran, Texanol-2,2,4-trimethyl-1,3-pentanediolmonoisobutyrate, tetrahydrofurfyl alcohol and triethylene glycol.

4. Foaming Enhancement Agents

To aid in lifting the contaminant from the surface and to promote its inclusion into the liquid-state composition, aerosol can packaging may be used with the inclusion of foam enhancement agents. Examples of these agents include: chlorofluorocarbons such as chlorodifluoromethane, chlorotetrafluoroethane, dichlorotetrafluoroethane, trichlorofluoromethane, and trichlorotrifluoroethane; ethers such as dimethyl ether; fluorocarbons such as perfluoropentane; halocarbons such as ethyl chloride; hydrocarbons such as butane, isobutane, pentans and propane.

5. Rheology Control Agents

The rheological properties of the liquid-state composition control the mass transport and spreading of the liquid-state composition and the degree to which penetration occurs in cracks, crevices and other inaccessible surface regions. To prevent the liquid-state composition from washing hazardous substances deeper into the surface, rheology control agents are used in amounts that yield a viscosity range of from about 50 to about 110 KU and a sag resistance range of from about 5 to about 45 wet mils (from about 0.5 to about 8% based on total weight of the liquid-state composition).

Examples of these agents include attapulgite clays, such as Attagel 50; hydroxyethyl cellulose, such as Cellosize QP-300 and Cellosize QP-4400; modified hydroxyethyl cellulosics, such as Natrosol Plus grade 330 associative cellulosic polymer; modified clays, such as Bentone LT and Bentone EW; poly (acrylic acid) systems, such as Acrysol TT-615 and Acrysol GS; polyether polyurethane associatives, such as Rheolate 255 and Rheolate 278, and proteins such as casein, water soluble polysaccharides and xanthan gum and guar.

6. Release Aids

Since ease of release will vary depending upon the nature of the surface and the particular liquid-state composition used, release aids can be used to achieve a cohesive to adhesive force ratio of greater than 1. The release aid generally is used in amounts ranging from about 0.1 to about 6% of the weight of the liquid-state composition. Examples of preferred materials are Aquabead 1250 synthetic wax, ammonium laurate, coconut diethanolamide, Dow 36 silicone emulsion, Epolene wax, Hoechst wachs UL Montan wax, glyceryl stearate, Jonwax 120 polyethylene wax, microcrystalline wax, paraffin wax, fluorocarbon wax, lauric diethanolamides, polyoxyethylene(10) cetyl ether, PPG-36 oleate, Shamrock S-Nauba 5021 carnauba wax, and sodium lauryl sulfate.

7. Agents Which Lower $T_g$

The polymeric component of the liquid-state composition may be in a dispersion form that is too rigid to effectively interact with the contaminant at the microscopic level. Agents which lower $T_g$ may be added to the liquid-state composition to help transform the rigid state to a plastic state which increases polymeric free volume and allows more main chain conformational interchange. The preferred compounds generally are used in amounts ranging from about 1 to about 15% of the total weight of the liquid-state composition.

Examples of these compounds include disproportionated rosin, Gilsonite, glycerol esters of rosin, hydrocarbon resin dispersions like Piccopale 85-55 wkx and Piccovar AP25-55 wkx, Eastman AQ 29D, Neville LX 685, Petrolatum 125 HMP, polybutenes, rosin esters, tall oil rosin, terpene resins, terpene-phenol resins, and Vinsol emulsion.

Volatile, non-resinous compounds also can be effective if they posses a solubility parameter value in the range of from about 7.5 to about 10.0 δ units. Examples of suitable non-resinous compounds include n-butyl acetate, n-butyl carbitol, carbitol acetate, cellosolve acetate, cyclohexane, dibutyl phthalate, diethyl ketone, ethyl acetate, isophorone, mesitylene, pine oil, solvesso 150, and turpentine.

8. Fire-Retardant Agents

While some polymeric components, e.g., Neoprene, are themselves fire-retardant, if a non-fire-retardant polymeric component is chosen, the safety of the abatement composition may be enhanced by including fire-retardant agents in the liquid-state composition. Examples of these agents include alumina trihydrate, aluminum hydroxide, ammonium phosphate, ammonium polyphosphate, antimony silico-oxide, antimony trioxide, antimony trioxide/chlorinated, paraffin mixtures, barium metaborate, borax, brominated compounds, such as 1,2-dibromoethylbenzene and dibromo-2-chloroethylbenzene, chlorinated paraffin wax, haloorganophosphorus compounds, magnesium hydroxide, melamine borate, organic phosphate esters, tricresyl phosphate, organic phosphonic acids, perlite, sodium tetraborate decahydrate, zinc borate, urea resins and vermiculite.

9. Other Additives and Pigments:

The liquid-state composition may contain other functional additives such as foam control agents, preservatives, mildewcides, flow control agents, colorants, cross-linking agents, antipica agents, and/or pigments, as needed and as readily recognized by those skilled in the art.

F. Chemical Drying Agents and Solidifying Compounds

The solid-state matrix-forming ability of a water-based, liquid-state composition may be markedly accelerated by overspraying the liquid-state composition with a chemical drying agent that rapidly converts the liquid state into a solid state. This process hastens the formation of the solid-state matrix, and shortens the time required to complete the abatement process. The time reduction can be substantial, reducing the amount of time it takes for the solid-state to form from as much as about 24 hours to a little as about 10 minutes. A drying agent may be used with both the single-coating and the two-coating processes of the invention.

Exemplary chemical drying agents include mixtures of:

a) dehydrating agents, such as ethyl alcohol, propyl alcohol, isopropyl alcohol and acetone;

b) zeta potential-neutralizing inorganic agents, such as $CaCl_2$, $Ca(NO_3)_2$, $ZnCl_2$, $MgCl_2$, $Al_2(SO_4)_3$, and sodium silicofluoride, ammonium silicofluoride, and potassium silicofluoride at 10 to 35% by weight levels in water;

c) pH lowering agents, such as phosphoric acid, acetic acid, chloroacetic acid, lactic acid, citric acid, and benzoic acid; and d) wetting agents, such as Triton X-100, Tergitol NPX and Surfynol 420 surfactant.

A typical example of a drying agent composition is:

| Compound | Parts by Weight |
|---|---|
| Water | 30 |
| $Ca(NO_3)_2$ | 20 |
| Ethyl alcohol | 48 |
| Triton X-100 | 1 |
| Bentone SD-2 | 1 |

If the overspray method is not preferred, an in-situ solidifying compound can be used that reduces the application process to a single step. To effect in-situ transformation from the liquid to the solid state, about 0.25 to about 6 parts of a solidifying compound such as ammonium silicofluoride, sodium silicofluoride, or potassium silicofluoride per hundred parts solid resin (phr) may be added to the liquid-state composition as a finely ground (e.g., ball milled) dispersion just prior to application.

The time required to form a solid-state will vary according to concentration of solidifying compound and polymer type. By way of example, when sodium silicofluoride was added to Neoprene 671 latex, the following results were attained.

| Time Required to Form Solid-State (minutes) | Sodium Silicofluoride Added (phr) |
|---|---|
| 150 | 2 |
| 18 | 2.5 |
| 7 | 3 |
| 5 | 4 |

Cleaning Capacity of Liquid-State Compositions

The cleaning capacity of a particular liquid-state composition depends upon the chemical and physical interaction between the particular contaminant and the particular polymeric component and optional additives. The formation of associations, bonds, and entrapment necessary for the sequestering of the contaminant requires intimate contact between the macromolecules of the polymeric component and the contaminated surface.

The ability to predict the surface interaction of a particular contaminant and liquid-state composition is somewhat limited, and therefore, the cleaning capacity of various liquid-state compositions should be investigated empirically. Such studies, which require only routine experimentation, can quickly and easily reveal useful liquid-state compositions for a particular contaminant.

One empirical method for determining the cleaning capacity of a particular liquid-state composition vis-a-vis a contaminant is exemplified below, using lead as the contaminant. From these studies it was unexpectedly discovered that the relationship between properties of the polymeric component and the cleaning capacity is highly complex. The capacities of several polymeric components to clean lead from a surface at high weight ratios of lead to solid-state matrix were determined by the following procedure.

Aluminum weighing dishes (57mm diameter, Baxter cat. number 02165-1) were degreased by rinsing with 2–3 ml of lacquer thinner (Klean Strip ML-170, W. M. Barr Inc.) and wiping dry with an Exsorbx 400 wiper (Bershire 400041).

After air drying for 30 minutes, the dishes were primed with a mixture consisting of 1 part PPG DP 40 epoxy primer, 1 part PPG DP 401 epoxy primer catalyst and 0.2 parts Klean Strip ML-170 lacquer thinner. The epoxy/catalyst/thinner mixture was given a 30 minute induction period, and then spray applied at 1–2 mils using a Binks 18 spray gun at 40 psi pressure.

After a 30 minute air dry period at ambient temperature, the primed dishes were overcoated at 2–3 mils wet film thickness with Sherwin Williams Promar 750 flat interior latex (B-30W 703) using a Binks 18 spray gun at 40 psi pressure. The dishes were allowed to air dry at ambient conditions for 24 hours and then cured for 3 hours at 175° F. Each dish was preweighed to 5 significant figures (0.0001 accuracy) and approximately 1.0 g of red lead powder (Baker Analyzed Reagent Grade #2334, $Pb_3O_4$ content 98.4%) then was added to each dish.

The broad end of a rubber stopper, size 00, was used to spread the lead powder over the latex surface using horizontal, forward and reverse shearing motions until none of the white latex surface remained visible. Loose dust was compacted by impacting with approximately 30 g of force for 20 up and down cycles. Each dish contained approximately $5.90\times10^9$ $\mu g/ft^2$ of lead particulate which represented a factor of $10^4$th beyond presently allowable residual limits. When compaction was complete, the lead-containing dish was weighed.

Two grams of the liquid-state composition were coated on the surface by spreading with a rolling action. The liquid-state composition was allowed to dry at ambient temperature for 18–24 hours, and the resulting solid-state matrix, including captured lead, was removed by manual peeling. The dish was reweighed, and the % lead pickup was determined by calculating the weight loss of the dish relative to the amount of lead applied. The potential lead to solid-state matrix ratio was determined by dividing the weight of lead removed by the weight of the solid state matrix. The cleaning capacity was calculated by dividing the weight of lead removed by the area of the surface cleaned. In one test, the following liquid-state composition was used:

| Liquid-State Composition | |
|---|---|
| Component | Parts by Weight |
| Water | 150 |
| Cellosize QP-300 | 4 |
| Troysol AFL | 5 |
| Tamol 850 | 3 |
| Witconate 79S | 6 |

-continued

| Liquid-State Composition | |
|---|---|
| Component | Parts by Weight |
| DABCO DC193 | 4 |
| KOH (10%) | 10 |
| Methyl propasol | 25 |
| Sodium sulfide indicator/converter | 10 |
| Mix the above in a blender until homogeneous at medium speed, then add: | |
| Dow Corning 36 | 140 |
| Dowicil 75 | 2 |
| Skane M-8 | 3 |
| Neoprene Latex 400 | 638 |
| Mix the above at medium speed for 10 minutes. | |

The cleaning capacity values obtained are given in Table 1.

TABLE 1

Capacity of Various Polymeric Compositions to Pickup Lead Particulate at Highly Elevated Levels

| Polymeric Component | % Lead Pickup | Potential Lead to Solid-State Matrix Ratio | Cleaning Capacity × $10^9$ (μg/ft$^2$) |
|---|---|---|---|
| Liquid-state composition described above | 95 | 1.3 | 4.9 |
| Neoprene 400 (chloroprene/2,3-dichloro-1,3-butadiene copolymer) | 93 | .9 | 4.8 |
| Tylac 68-074 (carboxylated acrylonitrile/1,3-butadiene copolymer) | 87 | 0.97 | 4.5 |
| Neoprene 750 (chloroprene/2,3 dichloro-1,3-butadiene copolymer) | 61 | .5 | 3.2 |
| Natural rubber latex with stabilizers | 55 | .46 | 2.9 |
| Butvar dispersion BR | 42 | .42 | 2.2 |
| Ucar vehicle 441 | 34 | .38 | 1.8 |
| Hycar 1570-19 (carboxylated acrylonitrile/1,3-butadiene copolymer) | 8 | 0.08 | 0.41 |
| Vacuumed 12 passes | 11 | | |

For comparative purposes, the above procedure was repeated using Neoprene 400 and Hycar 1570-19. The only variable changed was the degree to which the red lead was compacted into the dish surface, i.e., the 1.0 g of lead was simply spread over the surface with no pressing or grinding. This method yielded a potential lead to solid-state matrix ratio of 1.0 for the Neoprene 400 and 0.48 for the Hycar 1570-19. These polymeric components had potential lead to solid-state ratios of 0.9 and 0.08, respectively, in the original procedure. Thus, it is seen that the potential lead to solid-state ratios and cleaning capacities are dependent upon the degree to which the operator compacts the lead into the surface. Accordingly, to standardize the potential lead to solid-state ratio, a standard of Neoprene 400 can be used. The procedure outlined above, with 20 cycles of up and down impaction, is followed and the % lead pickup is calculated. This value should be about 90–93%, thereby yielding a potential lead to solid-state matrix ratio of about 0.9. If this value is not achieved initially, the procedure is repeated, adjusting the compaction as necessary, until a % lead pickup in the 90% range is obtained. Dishes standardized in this way can be used to determine the potential lead to solid-state matrix ratios of different polymeric components.

This study indicates that lead cleaning capacities vary considerably according to the identity of the polymeric component, and may vary significantly within compositionally-similar families. Thus, preferred liquid-state compositions for this invention have potential lead to solid-state matrix ratios of at least about 0.10, preferably at least about 0.25, more preferably at least about 0.60, and most preferably at least about 0.90. The term "about" used in the context of these ratios is intended to cover the range of experimental error, which is generally no more than 0.07, when determined by the above procedure. As seen from the results, examples of polymeric components which are useful for this invention include Neoprene latex, Tylac 68-074 and natural rubber latex. If these components are used, a smaller amount of optional additives can be used without compromising the abatement performance.

Those skilled in the art will readily recognize that similar procedures can be used for determining the cleaning capacity of other liquid-state compositions for contaminants. Where the contaminant is expected to be found in hard-to-reach places of a surface, such methods (like that described above) advantageously will measure the ability of the liquid-state composition to sequester contaminant imbedded in a surface.

Examples

The embodiments of the invention may be further illustrated through examples which show aspects of the invention in more detail. These examples illustrate specific elements of the invention and are not to be construed as limiting the scope thereof.

Example 1

This example illustrates the neutralization of a basic contaminant from a surface. In this example, an organic acid is used in the liquid-state composition to convert an ammonia-stabilized latex to an ammonium oleate-stabilized latex that tolerates the lower pH of excess oleic acid.

| Liquid-State Composition | |
|---|---|
| Component | Parts By Weight |
| Water | 190 |
| Cellosize QP-300 | 6 |
| Tamol 850 | 2.5 |
| Aerosol 22 | 15.5 |
| Hercules 501 Defoamer | 7 |
| Oleic Acid (Emersol 210) | 35.5 |
| Canguard 327 | 2 |
| Mix the above in a blender at medium speed until homogeneous, then add: | |
| Goodyear GNL-150 with 0.25% ammonia | 710 |
| Mix the above at medium speed for 5 minutes. | |

Characteristics of the composition

Goodyear GNL-150 contains 0.105 equivalents of ammonia in 710 g latex. The 35.5 g of oleic acid is equal to 0.126 equivalents of acid, or a 20% stoiometric excess, based on the amount of ammonia. The pH of the above-described liquid-state composition is about 5. The latex does not precipitate or shock out when the acid-containing liquid-state composition is applied because the in-situ formation of ammonium oleate stabilizes the dispersal phase.

Neutralization and Cleanup

The neutralization and cleanup was conducted on oak wood molding painted with multiple topcoats and a lead-based paint primer. The paint was overcoated ⅛ to ¼ inch thick with Diedrich Chemicals 404 Rip-Strip paint remover, which contains 23% liquid KOH. After a stripping time of 24 hours, the remover and liquified paint were scraped off with a spatula, and the surface was wiped with disposable toweling. pH testing with wet litmus indicated an alkalinity in excess of 14.

A post-paint removal neutralization was performed by misting the stripped surface with a 4/1 mixture of water/muriatic acid. The misting was performed three times at 30 minute intervals until the pH of the surface reached 7.

Upon reaching outermost surface neutrality, the residual paint sludge was cleaned by applying the liquid-state composition described above. The composition was poured onto the surface, and scrubbed with a hand scrub brush for 15 clockwise cycles followed by 15 counterclockwise cycles. Any uneven thicknesses of the composition were evened out by using a disposable sponge brush and adding additional liquid-state composition to achieve a wet film thickness of 60 mils. The liquid-state composition was allowed to solidify into a solid-state matrix, which was removed after 15 hours of drying time.

Results

Visual inspection at 7× magnification indicated that the wood pores were clean of paint/stripper residue. The pH of the surface was between 5 and 7, and wipe analysis indicated that the lead content was below 500 micrograms/ft$^2$. Thus, effective cleaning and a neutral surface, suitable for repainting, were achieved without water rinsing.

Example 2

This example illustrates the neutralization of a basic contaminant from a surface. In this example, acetic acid is used as the base-neutralizing agent, and the composition is prepared through a staged addition process to avoid shock.

Liquid-State Composition

| Component | Parts By Weight |
|---|---|
| Water | 30 |
| Methocel J5MS | 3 |
| Triton X-114 | 2 |
| Triton GR-7M | 7.5 |
| Mix the above until uniformly dispersed, then add: | |
| Goodyear GNL-150 with 0.25% ammonia | 710 |
| Mix the above at high speed until thick, then add: | |
| Acetic acid (5%) | 180.5 |
| Triton X-114 | 3 |
| Triton GR-7M | 7.5 |
| Mix the above at high speed for 5 minutes | |

Characteristics of the composition

This composition contains a total of 0.151 equivalents of acetic acid, or 0.045 equivalents in excess of the ammonia. The pH of the composition is about 5. The addition of the acetic acid in the last stage of ingredient blending resulted in shock-free acceptance of the composition.

When, instead of following the above procedure, the acetic acid was added in the first stage of the ingredient blending, the undesirable effect of complete coagulation of the latex resulted.

Neutralization and Cleanup

Neutralization and cleanup was conducted on brick painted with multiple topcoats and a lead-based paint primer. The paint was overcoated ⅛ to ¼ inch thick with Dumond Chemicals Peel Away 1 alkaline stripper, which contains NaOH, and covered with a plastic/paper blanket. After a stripping time of 24 hours, the loosened paint was peeled back using a spatula, and pulling back the covering material. Remaining liquid and sludge were wiped up with disposable toweling. pH testing indicated a surface alkalinity in excess of 14.

A post-paint removal neutralization was performed by misting the stripped surface with glacial acetic acid. Surface saturated misting was continued 4 times in 30 minute intervals, and yielded a surface pH of 7.

Next, the liquid-state composition described above was spread over the surface with a disposable sponge brush and scrubbed with number 1 steel wool for 10 forward and 10 reverse passes. After scrubbing, fresh liquid-state composition was added and smoothed out to achieve a wet film thickness of about 65 mils. The liquid-state composition was allowed to solidify into a solid-state matrix over an 18 hour period, after which it was easily removed.

Results

Visual inspection indicated that the brick was free of paint sludge and residue. The pH of the surface was between 5 and 7, and wipe analysis indicated a residual lead content of 723 micrograms/ft$^2$. Thus, both effective neutralization of the caustic contaminant and extraction of impregnated lead was achieved without water rinsing.

Example 3

This prophetic example illustrates the neutralization of an acidic contaminant from a surface. In this example, sodium metasilicate is used as a mild, effective acid-neutralizing agent.

Liquid-State Composition

| Component | Parts By Weight |
|---|---|
| Water | 160 |
| Natrosol 250 HR | 3 |
| Foamaster NDW | 4 |
| Miranol JEM | 3 |
| Surfadone LP 100 | 2 |
| Sodium metasilicate pentahydrate | 30 |
| Proxel HL | 2 |
| Mix the above until uniformly dispersed, then add: | |
| Bayprene L-370 | 666 |
| Jonwax 120 | 130 |
| Mix the above at medium speed for 10 minutes. | |

The surface for this example is a steel surface coated with a lead-free alkyd maintenance paint. The paint is coated ⅛ to ¼ inches thick with an acidic stripper consisting of 55 parts dichloromethane, 3 parts toluene, 2 parts paraffin, 7.5 parts methanol, 6 parts ethylene glycol monoethyl ether, 5 parts formic acid, 4 parts cresylic acid, 7.4 parts phenol, 5.5 parts dodecylbenzenesulfonic acid and 4.6 parts water. After a contact time of 16 hours, the paint is removed with a scraper. The surface is tested with wet litmus paper, which indicates the presence of a strongly acidic residue.

A post-paint removal neutralization is performed by pouring the liquid-state composition described above onto the stripped surface at a concentration of 5 oz/ft$^2$. The liquid-state composition and acidic residue are commingled by mixing with a brass bristled brush using 10 clockwise cycles followed by 10 counter-clockwise cycles. The mixture is then smoothed out using a 3-inch disposable sponge brush.

After a coalescence period of 16 hours at 75° F. and 50% humidity, the liquid-state composition converts into a tough elastomeric film which is easily removed by manual peeling. The surface appears free of paint/stripper residue, and testing with wet litmus indicates that the acidic compounds are no longer present.

Example 4

This prophetic example illustrates the absorbance of organic contaminants from a surface. In this example, organic stripper/paint residues are absorbed by activated carbon, vermiculite and diatomaceous silica (Celite 289 Gardner-Coleman, oil absorption of 210 g/100 g).

| Liquid-State Composition | |
|---|---|
| Component | Parts By Weight |
| Water | 170 |
| Methocel J5MS | 3.5 |
| Colloid 640 | 5 |
| Lodyne S-103 | 2 |
| Triton X-100 | 4 |
| Tamol 730 | 8 |
| Activated Carbon, Darco G-60 | 40 |
| Vermiculite | 35 |
| Celite 289 | 50 |
| Mix the above until a Hegman Value of 1–2 is attained, then add: | |
| Shamrock S-395 wax | 30 |
| Neoprene 400 latex | 660.5 |
| Mix the above at medium speed to 10 minutes. | |

The surface for this example is a white tile surface coated with a titanium-dioxide-based latex paint. The paint is stripped by applying an organic stripper at a thickness of ⅛ to ¼ inches. The stripper consists of 45 parts dichloromethane, 15 parts dimethyl formamide, 12 parts tetrahydrofuran, 10 parts acetone, 5 parts methanol and 3 parts hydroxypropyl cellulose thickener. The stripper solution is colored with Oil Blue N at 0.5% for visual detection. After 2 hours of contact, the paint is removed with a scraper. The residual mixture of paint and stripper appear as a light blue semi-solid on the tile surface.

The liquid-state composition described above is applied to the surface at a concentration of 3.5 oz/ft$^2$. The liquid-state composition and the organic stripper residue are co-mixed by scrubbing with a nylon bristle brush using 10 forward and 10 reverse passes. The mixture is then evened out using a disposable sponge brush. To hasten film removal, the drying agent described hereinabove is oversprayed at a level of 2–4 mils wet film thickness on the liquid-state composition surface.

After a period of 3 hours at 75° C. and 50% humidity, the film strength is sufficient for the film to be peeled away without tearing. The cleaned surface appears white, and neither stripper residue nor blue dye is visually detected.

Example 5

This prophetic example illustrates the neutralization of a basic contaminant from a surface. In this example, a non-aqueous liquid-state composition is used as the neutralizing agent.

| Liquid-State Composition | |
|---|---|
| Component | Parts By Weight |
| Methyl ethyl ketone | 120 |
| M-pyrol | 200 |
| Ucar VAGH vinyl resin | 70 |
| Acetic acid (99%) | 25 |
| Aerosil 200 | 18 |
| Mix the above at medium-high speed in a blender until a Hegman Value of 4 is attained, then add: | |
| Acetone | 160 |
| Tetyrahydrofuran | 80 |
| Ucar VYNS-3 | 70 |
| Triton X-35 | 5 |
| Emphos PS 220 | 5 |
| Blown caster oil | 25 |
| Mix the above until homogenous. | |

The surface for this example is aluminum coated with a lead-free, epoxy ester industrial paint. The paint is overcoated ⅛ to ¼ inches thick with Peel Away 1 alkaline stripper and covered with a plastic/paper blanket. After a stripping time of 36 hours, the loosened paint is peeled back using a scraper and pulling back the blanket. The remaining liquid and sludge is wiped up with disposable toweling. Testing the surface with wet litmus indicates a pH in excess of 14.

The non-aqueous liquid-state composition described above is applied to the surface at a concentration of 1.5 oz/ft$^2$ using a polyester paint brush. The liquid-state composition and stripper residue are commingled by using 10 forward and reverse passes of a brush. This mixture is smoothed out, and additional liquid-state composition is added to achieve a wet film thickness of about 70 mils. The liquid-state composition is allowed to dry at 75° F. and 50% humidity for 24 hours, after which the film is easily removed by manual peeling. Visual inspection indicates that the surface is free of paint sludge and residue. Testing with wet litmus indicates a surface pH of approximately 7.

Example 6

This prophetic example illustrates a process wherein two functionally different coatings are applied to the surface to be cleaned. In this example, the first coat neutralizes alkali and cleans lead paint residue and the second coat provides enhanced removability. Cost reduction is achieved by using less of the more expensive ingredients (such as Neoprene) than would be needed in a single-coating process.

| Liquid-State Composition for Scrubbing, Neutralizing Alkali and Capturing Lead (Surface Contact Composition) | |
|---|---|
| Component | Parts By Weight |
| Water | 145 |
| Natrosol Plus 330 | 3 |
| Colloid 640 defoamer | 4 |
| Witconate AOS-EP | 35 |
| Witconol NP-100 | 27 |
| Oleic acid | 75 |

-continued

| Liquid-State Composition for Scrubbing, Neutralizing Alkali and Capturing Lead (Surface Contact Composition) | |
|---|---|
| Component | Parts By Weight |
| Mix the above until uniformly dispersed, then add: | |
| Neoprene Latex 400 | 779 |
| Mix the above until homogenous. | |

(Where cleaning is required but surface neutralization is not needed, a surface contact composition as described above but without the oleic acid can be used.)

| Liquid-State Composition for Overcoating and Providing Tear Resistance (Overcoat Composition) | |
|---|---|
| Component | Parts By Weight |
| Water | 175 |
| Rheolate 255 | 3.5 |
| Bubble Breaker 260 | 5 |
| Emcol 4500 | 32 |
| Witconol 1206 | 18 |
| Fybrel Synthetic Fiber | 5 |
| Amerstat 300 | 3 |
| Mix the above at high speed to a Hegman grind value of 2, then add. | |
| Dresinol 215 polymerized rosin | 130 |
| Enmar Latex NC-411 | 628.5 |
| Mix the above at low to medium speed until homogenous. | |

Neutralization and Cleanup

Neutralization and cleanup is performed on a wood surface painted with several coats of aged, lead-containing, oil-based paint. The paint is coated ⅛ to ¼ inches thick with Pb Control Caustic Paste by Grayling Industries, which is allowed to act over a 20 hour period. The resulting paint/stripper sludge is removed by scraping. Testing with wet litmus paper indicates the presence of a strongly alkaline residue. The remaining alkaline residue is partially neutralized by misting the surface with 50% glacial acetic acid. The surface pH after misting is about 8–9.

The surface contact composition set forth above is poured onto the surface at a concentration of 1 oz/ft$^2$, and is scrubbed into the surface using 5 clockwise and 5 counterclockwise circular actions at moderate pressure with a scrub brush. After scrubbing, the surface contact composition is smoothed out with a disposable sponge brush.

Overcoat and Removal Enhancement

After even distribution of the surface contact composition, the overcoat composition set forth above is applied to the surface at 40 mils wet film thickness using a Titon Elite E20 airless spray pump. The two-layer composite is allowed to dry for 16 hours at 50% humidity and 70° F. The resulting solid-state matrix is then removed by manually pulling the film back over itself. No delamination of the two coatings occurs on removal, and visual inspection at 10× magnification reveals no paint sludge remaining on the surface. The pH of the surface is about 6–7.

It will be apparent to those skilled in the art that various modifications and variations can be made to the processes and compositions of this invention. Thus, it is intended that the present invention cover the modifications and variations of this invention provided they come within the scope of the appended claims and their equivalents.

What is claimed is:

1. A process for substantially cleaning a surface that has been treated with a chemical paint remover, wherein said chemical paint remover comprises an organic, acidic or basic compound, and wherein said surface is contaminated with said compound, said process comprising the steps of:

(A) applying a liquid-state composition to said surface, wherein said liquid-state composition comprises:

(i) a polymeric component and (ii) an agent selected from the group consisting of an absorbant, an acid-neutralizing agent, and a base-neutralizing agent; and wherein said liquid-state composition has a cleaning capacity of about 0.10;

(B) allowing said liquid-state composition to interact with said compound to form a product and to solidify into a solid-state matrix, thereby sequestering said product in said solid-state matrix; and (C) removing said solid-state matrix from said surface.

2. The process of claim 1, wherein said compound is an organic contaminant and said agent is an absorbant.

3. The process of claim 2, wherein said absorbant is selected form the group consisting of gypsum, calcium carbonate with oil absorption above 20 g/100 g pigment, silica, china clay, talc, asbestine, mica, bentonite, carbon black, activated carbon, vermiculite and perlite.

4. The process of claim 2, wherein said absorbant comprises from about 1% to about 40% of the liquid-state composition, based on the total weight of said liquid-state composition.

5. The process of claim 2, wherein said compound is selected from the group consisting of dichloromethane, chloroform, 1,1,2-trichloroethane, 1,2,3-trichloropropane, dichlorobenzenes, dimethylsulfoxide, dimethyl formamide, furfural, methanol, propanol, tetrahydrofuran, methyl ethyl ketone, acetone, anisole, butyl acetate, cyclohexanone, limonene, propylene glycol, butyl cellosolve, ethoxyethanol, ethyl acetate, ethylene glycol monomethyl ether, methypyrrolidone, benzyl alcohol, diacetone alcohol, dioxane, toluene, dimethyl phthalate, dimethyl acetamide, xylene, hydrocarbons, petroleum distallates, naphtha, naval stores, and dialkyl maleates.

6. The process of claim 1, wherein said compound is acidic and said agent is an acid-neutralizing agent.

7. The process of claim 6, wherein said acid-neutralizing agent is selected from the group consisting of alkali metal bicarbonates, alkali metal hydroxides, ammonium hydroxide, alkali metal phosphates, alkali metal silicates, dialkyl substituted ammonia derivatives, monoalkyl substituted ammonia derivatives, and trialkyl substituted amines.

8. The process of claim 7, wherein said acid-neutralizing agent is selected from the group consisting of sodium bicarbonate, cesium hydroxide, potassium hydroxide, sodium hydroxide, tetrapotassium pyrophosphate, trisodium phosphate, potassium metasilicate, sodium metasilicate, dimethylamine, diethylamine, diisopropylamine, diethanolamine, morpholine, piperazine, piperidine, methylamine, ethylamine, and ethanolamine, trimethylamine, triethylamine and triethanolamine.

9. The process of claim 6, wherein said acid-neutralizing agent comprises from about 0.1% to about 20& of the liquid-state composition, based on the total weight of said liquid-state composition.

10. The process of claim 6, wherein said compound is selected form the group consisting of acetic acid, chloroacetic acid, aromatic thiols, phenol, cresol, formic acid, oxalic acid, glycolic acid, phosphoric acid, toluenesulfonic acid, fluorosulfuric acid, hydrofluoric acid, hydrochloric acid, sulfuric acid and nitric acid.

11. The process of claim 1, wherein said compound is basic and said agent is a base-neutralizing agent.

12. The process of claim 11, wherein said base-neutralizing agent is selected from the group consisting of mineral acids and organic acids.

13. The process of claim 12, wherein said base-neutralizing agent is selected from the group consisting of hydrochloric acid, phosphoric acid, nitric acid, sulfuric acid, boric acid, carbonic acid, and chromic acid, acetic acid, adipic acid, benzoic acid, butyric acid, chloroacetic acid, citric acid, cresol, dichloroacetic acid, formic acid, fumaric acid, lactic acid, malonic acid, napthalenesulfonic acid, oleic acid, oxalic acid, phenolic acid, phthalic acid, quinolinic acid, and uric acid.

14. The process of claim 11, wherein said base-neutralizing agent comprises from about 0.5% to about 25% of the liquid-state composition, based on the total weight of said liquid-state composition.

15. The process of claim 11, wherein said compound is selected from the group consisting of sodium hydroxide, sodium metasilicate, potassium hydroxide, lithium hydroxide, calcium hydroxide, calcium oxide, trisodium phosphate, ammonium hydroxide, ethylenediamine, polyethylenepolyamines, triethanolamine, hydrazine, morpholine, pyridine, and quaternary ammonium compounds.

16. The process of claim 1, further comprising a step of using a chemical drying agent.

17. The process of claim 16, wherein said liquid-state composition comprises said drying agent.

18. The process of claim 16, wherein said drying agent is applied after said liquid-state composition has been applied.

19. The process of claim 1, wherein said polymeric component is selected from the group consisting of polacrylonitrile-containing copolymers, acrylonitrile/butadiene/styrene copolymers, butadiene copolymer rubbers, butadiene-styrene copolymers, chlorinated butadiene-styrene rubbers, chlorinated butyl rubbers, chlorinated isoprene rubbers, chlorinated polyethylenes, chlorosulfonated polyethylenes, chlorinated rubbers, chlorinated Neoprene rubber, chloroprene rubber, chloroprene copolymers with methacrylic acid, chloroprene copolymers with 2,3-dichloro-1,3-butadiene, cellulosics, cellulose ethers, natural rubbers, epoxidized natural rubbers, phosphazene rubbers, polyacrylate homopolymers, polyacrylate copolymers, polyacrylate vehicles, polyacrylate copolymers containing acrylic acids, polyacrylate copolymers containing methacrylic acids, polydimethylsiloxanes, polysulfide rubbers, poly(vinyl acetate) homopolymers, poly(vinyl acetate) copolymers, poly(vinyl alcohols), poly(vinyl butyral), poly(vinyl formal), poly(vinyl chloride) homopolymers, poly(vinyl chloride) copolymers, chlorinated poly(vinyl chlorides), poly(vinyl chloride-vinyl acetate) copolymers, urethane rubbers, polyether urethanes, polyester urethanes, polyurethane dispersions, epichlorohydrin rubbers, ethylene oxide/propylene oxide rubbers, isobutylene rubbers, and poly(perchloroethylenes).

20. The process of claim 1, wherein said surface is further contaminated with lead from paint.

21. The process of claim 20, wherein said paint comprises at least about 0.05% lead.

22. The process of claim 21, wherein said paint comprises at least about 0.5% lead.

23. The process of claim 20, wherein said lead is selected from the group consisting of lead driers, basic carbonate white lead, basic sulphate white lead, basic silicate white lead, leaded zinc oxide, red lead, lead chromate, lead oxide chromate, and lead molybdate.

24. The process of claim 1, wherein said solid-state matrix is removed from said surface by peeling said solid-state matrix away from said surface.

25. The process of claim 1, wherein said surface is selected from the group consisting of wood, cement, brick, cinder block, plasterboard, and wall board.

26. The process of claim 1, wherein said surface is selected from the group consisting of steel, aluminum and tile.

27. A process for substantially cleaning a surface that has been treated with a chemical paint remover, wherein said chemical paint remover comprises an organic, acidic or basic compound, and wherein said surface is contaminated with said compound, said process comprising the steps of:

(A) applying a liquid-state composition to said surface, wherein said liquid-state composition comprises an agent selected from the group consisting of an absorbant, an acid-neutralizing agent, and a base-neutralizing agent;

(B) applying a second liquid-state composition to said surface, wherein said second liquid-state composition comprises a polymeric component and has a cleaning capacity of about 0.10;

(C) allowing said liquid-state compositions to interact with said compound to form a product and to solidify into a single solid-state matrix, thereby sequestering said product in said solid-state matrix; and (D) removing said solid-state matrix from said surface.

28. A process according to claim 27, wherein said second liquid-state composition enhances the removability of said solid-state matrix from said surface.

* * * * *